United States Patent [19]

Richards et al.

[11] 4,280,916

[45] Jul. 28, 1981

[54] LUBRICANT COMPOSITION

[75] Inventors: Harry F. Richards, Missouri City; Douglas C. Carlson, Houston, both of Tex.

[73] Assignee: Shell Oil Company, Houston, Tex.

[21] Appl. No.: 135,819

[22] Filed: Mar. 31, 1980

[51] Int. Cl.[3] ..... C10M 1/32; C10M 1/40; C10M 1/48

[52] U.S. Cl. ..... 252/33.4; 252/51.5 A; 252/46.7

[58] Field of Search ..... 252/46.7, 51.5 A, 33.4

[56] References Cited

U.S. PATENT DOCUMENTS

| | | | |
|---|---|---|---|
| 3,945,931 | 3/1976 | Bussi et al. | 252/33.4 UX |
| 4,120,803 | 10/1978 | Malec | 252/51.5 A |
| 4,152,342 | 5/1979 | Kelyman et al. | 252/51.5 A X |
| 4,208,293 | 6/1980 | Zawoski | 252/51.5 A |

*Primary Examiner*—Paul F. Shaver

*Attorney, Agent, or Firm*—Ronald R. Reper

[57] ABSTRACT

Motor oil compositions formulated for use as crankcase lubricants in internal combustion engines are improved by including in said motor oil a small amount of at least one $C_8$–$C_{24}$ aliphatic monocarboxylic acid amide, resulting in reduced fuel consumption of said internal combustion engines operated with said motor oil.

10 Claims, No Drawings

LUBRICANT COMPOSITION

BACKGROUND OF THE INVENTION

This invention relates to lubricating oil compositions for use as crankcase lubricants in internal combustion engines, and more particularly to hydrocarbon oil compositions which can reduce fuel consumption of internal combustion engines operated using said lubricating oil in the crankcase of said engine.

The trend today in the design of new internal combustion engines, and particularly those engines employed for vehicular transportation, is toward increasing fuel economy to conserve rapidly depleting hydrocarbon resources. Further there is great need for improved lubricants which can further reduce fuel consumption of existing engines, and particularly spark-ignition internal combustion engines.

Owing to the improvements in mechanical design over the years most engines in use today require but a small portion of fuel consumed to overcome friction. For example, it has been estimated that a modern vehicular gasoline engine being operated to cruise at e.g. 88 km/h (55 miles per hour) would consume only about eight percent of the fuel to overcome internal friction; with the remainder of the heat energy of the fuel going primarily to the coolant, exhausted gases and to work output of the engine. Accordingly, fairly substantial improvement in crankcase lubricant frictional properties will be required to reduce fuel consumption by even one or two percent for a given work output of the engine. Moreover, such improvement must be accomplished without adversely affecting other important properties of the crankcase oil such as detergency, antiwear and load-carrying properties.

SUMMARY OF THE INVENTION

The lubricating oil compositions of this invention comprise a major amount of a mineral hydrocarbon oil of lubricating viscosity containing an ashless dispersant, an oil-soluble detergent sulfonate, salicylate and/or phenate, and an effective amount of at least one $C_8$–$C_{24}$ aliphatic carboxylic acid amide sufficient to reduce fuel consumption of an internal combustion engine employing said motor oil composition as the crankcase lubricating oil of said engine.

The invention further provides a method for reducing the fuel consumption of an internal combustion engine which comprises incorporating into the crankcase lubricant of said engine an effective amount of at least one $C_8$–$C_{24}$ aliphatic monocarboxylic acid amide sufficient to reduce the fuel consumption of said engine and operating said engine for a time sufficient to disperse said aliphatic monocarboxylic acid amide throughout the oil-contacted internal surfaces of said engine.

DESCRIPTION OF PREFERRED EMBODIMENTS

The $C_8$–$C_{24}$ aliphatic acid mono-amides employed in this invention may be saturated but preferably are unsaturated compounds derived from fatty acid components of naturally occurring fats and oils. Such amides are well known in the art and are described e.g. in Kirk Othmer, Encyclopedia of Chemical Technology, Second Edition, Volume 2, pages 72–76. They have been employed as thickening agents for paints and varnishes and printing inks and as load-carrying additive for lubricants such as metal cutting fluids, metal drawing and stamping compounds, chain lubricants, gear oils and the like, however, insofar as applicants are aware they have not heretofore been utilized in formulated crankcase oils.

The general structural formula of these compounds is:

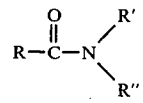

wherein R represents an alkyl or alkenyl hydrocarbyl radical having from 8 to 24 carbon atoms, and R′ and R″ which may be the same or different represent hydrogen or lower alkyl radical having up to 7 carbon atoms. Preferred compounds are those wherein R represents an alkenyl radical of from about 12 to about 20 carbon atoms and R′ and R″ are each hydrogen or an alkyl radical having from 1 to 4 carbon atoms. Particularly preferred are compounds wherein R represents an alkenyl radical having from 14 to 18 carbon atoms and R′ and R″ are each hydrogen. It should be understood that the alkenyl radical R may contain one, two or three ethylenically unsaturated bonds.

Exemplary compounds include caprylamide, pelargonamide, lauramide, myirstamide, palmitamide, oleamide, eladamide, linoleamide, linolenamide, behanamide, erucamide and lignoceramide. Because of their commercial availability and lower cost it is preferred to use amides obtained from mixtures of fatty acids. The aliphatic acid amide may vary within the range of 0.01 and 3.0% by weight and preferably will be present from about 0.05 to about 1.0% by weight of the finished oil.

The hydrocarbon oil component generally is a lubricating oil fraction of petroleum, preferably either naphthenic and/or paraffinic base which may be unrefined, but preferably has been upgraded by one or more conventional procedures such as distillation, acid refining, solvent refining, dewaxing, hydrotreating, hydrocracking and the like. Thus the base oil may be an oil of wide viscosity range, e.g. 100 SUS at 100° F. to 150 SUS at 210° F. The hydrocarbon oils may be blended with synthetic lubricants such as polymerized olefins, organic esters of poly-basic organic and inorganic acids, e.g. di-2-ethylhexyl sebacate; polyalkyl silicone polymers, e.g. dimethyl silicone polymer and the like. If desired, the synthetic lubricant may be used as the sole base lubricant. The base composition described above will be formulated with supplementary additives to provide the necessary stability, detergency, dispersancy, antiwear, and anticorrosion properties required of modern crankcase lubricants.

Among such supplementary additives are polymeric succinic acid derivatives used as detergent-dispersants. These can be made by the process described in U.S. patents to Hughes U.S. Pat. No. 3,215,632 issued Nov. 2, 1965; to Rense U.S. Pat. No. 3,215,707, issued Nov. 2, 1965; to Stuart et al U.S. Pat. No. 3,202,678 issued Aug. 24, 1965, or LeSuer et al Canadian Pat. No. 681,235 issued Mar. 3, 1964, and can be illustrated by examples (1) succinimide of mono(polyisobutylene) succinic anhydride and tetraethylene pentamine, the polyisobutylene radical having a molecular weight of about 1,000 (2) tetraethylene pentamine having a molecular weight of about 1,000 (3) succinimide of mono(polypropylene)

succinic anhydride and diethylene triamine, the polypropylene radical having a molecular weight of 800–1,500. (4) diimide of mono(polyisobutylene) succinic anhydride and tetraethylene pentamine, the polyisobutylene radical having a molecular weight of 800–1500.

The most preferred ashless dispersants to be used in the lubricants of the present invention are polyisobutenyl succinates achieved by providing oil-soluble compositions prepared by reacting under esterification conditions (A) at least one substituted polycarboxylic acid acylating agent containing an average of at least about 30 aliphatic carbon atoms per substitutent with (B) at least one polyhydric alcohol in amounts such that there is at least one equivalent of polyhydric alcohol for each equivalent of substituted carboxylic acid acylating agent to form an ester-containing first reaction mixture and thereafter intimately contacting this first reaction mixture with (C) from about 0.025 to about 0.15 equivalent of at least one hydroxy-substituted primary amine per equivalent of (A). These reaction products and their preparation are described, e.g., in Krukziener U.S. Pat. No. 3,331,776 and in Widmer et al U.S. Pat. No. 3,576,743, issued Apr. 27, 1971. Still more preferably, (A) is further characterized in that it is a substantially saturated acylating agent produced by reacting ethylenically unsaturated carboxylic acidic reactant of the formula $$R_O\text{-}(COOH)_n$$

or the corresponding carboxylic acid halides, anhydrides, and esters where $R_O$ is characterized by the presence of at least one ethylenically unsaturated carbon-to-carbon covalent bond and n is an integer of two to six, preferably two, with an ethylenically unsaturated hydrocarbon or chlorinated hydrocarbon containing at least thirty aliphatic carbon atoms at a temperature within the range of 100°–300° C. with the proviso that said acylating agent may contain polar substituents to the extent that such polar substituents do not exceed 10% by weight of the hydrocarbon portion of the acylating agent excluding the weight of the carboxylic acid groups. The use of such detergents results in a substantial reduction (e.g., 15–50%) in the ash level compared to the use of other detergents which may otherwise be effective and satisfactory, such as the succinimides of high molecular weight mono(polyolefin)succinic anhydride and polyalkylene polyamines. Mannich ashless dispersants such as Mannich condensation products of polyolefin-substituted benzenes, formaldehyde and polyethylene polyamine are less suitable. Based upon very limited testing, it has been found that use of such Mannich-benzene condensation products in crankcase formulations has resulted in reduced effectiveness of the fuel economy benefits achieved according to the invention. Accordingly, the substituted benzene Mannich dispersants are not used in the preferred compositions of the invention. The ashless dispersants used in the lubricating oil compositions of this invention are generally present in amounts from 0.1 to 10% w and preferably from 2 to 5% w of the finished oil.

The sulfonates can be neutral and/or basic oil-soluble sulfonates derived from any suitable material and prepared by any of the well-known suitable methods. Preferred materials for making oil-soluble sulfonates include mineral lubricating oil fractions, alkyl-substituted polar containing aromatic compounds. Petroleum sulfonates suitable for use in compositions of this invention are described in U.S. Pat. Nos. 2,280,419; 2,344,988; 2,361,804; 2,375,222; 2,480,638; 2,485,861; 2,509,863; 2,501,731; 2,523,582 and 2,585,520. The sulfonates can be purified by the methods described in U.S. Pat. Nos. 2,411,583; 2,418,894; 2,442,915; 2,483,501; 2,531,324; 2,556,108 and 2,556,848. Although various metal sulfonates are contemplated in the practice of the invention, including alkali metal sulfonates, alkaline earth metal sulfonates (including magnesium) and other polyvalent metal sulfonates, particularly other divalent metal sulfonates and trivalent metal sulfonates, the sulfonates of the metals of group II of the periodic table and having an atomic number from 12 to 56, inclusive, are preferred, and especially of the alkaline earth metals within that group of metals. Specific sulfonates which are particularly suitable for use in compositions of this invention include oil-soluble metal sulfonates such as Na, K, Li, Ca, Ba, Mg, Zn, Al, In, Sn, Cr and Co petroleum sulfonate, tetratertiary-butylnaphthalene sulfonate, diwaxbenzenesulfonate, stearylbenzenesulfonate, diwaxnaphthalenesulfonate, diisobutylenephenolsulfonate, tertiary-octylphenol sulfonate, ditertiary-amylphenol sulfonate, alkylateddibenzothiophene sulfonate and mixtures thereof.

Alkaline earth metal overbased petroleum sulfonates also may be employed. The highly basic alkaline earth metal (Mg, Ca and/or Ba) petroleum sulfonate can be made by suitable means known in the art such as described in British Pat. Nos. 790,471 and 818,323 or Ellis et al U.S. Pat. No. 2,865,956. The basic calcium petroleum sulfonates (M.W. 300–800) are preferred. By basic sulfonate is meant that the end product has a basicity in excess of 20% and up to 1800% and preferably between 40% and 1400% in excess of that normally required to neutralize the acid to produce the normal salt.

The phenates suitable for use in compositions of this invention include those described in U.S. Pat. Nos. 2,197,833; 2,228,654; 2,280,419; 2,344,988; 2,361,804; 2,410,652; 2,501,991; 2,501,922 and 2,610,982. Specifically, they can be either simple phenates such as metal alkylphenates (Ca-cetylphenate), polar substituted simple phenates (Ca or Zn alkylsalicylates) or polyphenates such as where a plurality of the simple phenates are condensed at positions ortho and/or para to the phenolic hydroxy group through alkylidene (methylene) radicals or other suitable divalent non-metallic radicals, such as sulfur or selenium. Although various metal phenates are contemplated in the practice of the invention including mono- and polyvalent metal phenates, such as the alkali, alkaline earth and heavy metal phenates of which preferred are the polyvalent metal phenates of the metals of group II of the periodic table and having an atomic number from 12 to 56, especially the alkaline earth metals within that group of metals. Illustrative compounds are: Na, K, Li, Ca, Ba, Sr, Mg, Zn, Al, Cd, Ni, Fe, Co cetyl phenate, dibutyl phenate, $C_{14-18}$-salicylate, octyl thiophenate, cyclohexyl phenate, cetyl phenol sulfide, as well as the above metal salts of the condensation product of alkyl phenol with formaldehyde, acetaldehyde or benzaldehyde, e.g., Ca, Ba or Mg salts of octyl phenol-formaldehyde condensation product ranging in molecular weight of from 500 to 1,100.

The detergent sulfonates and/or phenates used in lubricating compositions of this invention are generally present in amounts of from 0.01% to 15%, and preferably from 0.5 to 5.0% by weight of the finished oil.

Further, preferred supplementary additives are dithiophosphates e.g., Ca, Zn, Pb salts of alkylthiophosphates, as well as their thio derivatives, Zn bis(2-ethylhexyl)dithiophosphate, Zn dioctyl dithiophosphate, Zn bis(alkylphenyl)dithiophosphate, $P_2S_5$-terpene reaction product, phosphonates such as dibutyl methane phosphate, dibutyl trichloromethane phosphonate, dibutyl monochloromethane phosphate, dibutyl chlorobenzene phosphonate, and the like. The full esters of pentavalent phosphorus acids may be used, such as triphenyl, tricresyl, trilauryl and tristearyl orthophosphates or potassium salt of $P_2S_5$-terpene reaction products or zinc above, like Zn di($C_{4-10}$ alkyl)dithiophosphate, e.g. Zn bis(2-ethylhexyl)dithiophosphate, Zn bis(alkylphenyl)-dithiophosphate. Corresponding dithiocarbamates, preferably zinc salts, also may be employed. The dithiophosphate or dithiocarbamate may be present in amounts from 0.1 to 2.5% by weight, and preferably will be present in amounts from about 0.5 to about 2% by weight of the finished oil.

Additionally, the compositions according to this invention may contain viscosity index (VI) improver additives. Many such additives are commercially available and include copolymers of ethylene and propylene. A particularly preferred class of viscosity improvers are copolymers formed from a vinyl aromatic monomer and a conjugated diene monomer, e.g., styrene/butadiene and styrene/isoprene such as disclosed in U.S. Pat. Nos. 3,763,044; 3,772,196; 3,994,815 and 4,381,390; and hydrogenated star-shaped polymers of polyalkenyl arenes/conjugated dienes as described, e.g., in U.S. Pat. Nos. 4,116,917 and 4,156,673. Another class of VI improvers are the acyclic polymers of cyclopentadiene as described in U.S. Pat. No. 4,051,051. Very suitable are dispersant VI improvers such as alkyl methacrylate-vinyl pyrrolidone copolymers; styrene-vinyl ester-vinyl morpholine-terpolymers; alkyl methacrylate-vinyl pyridine copolymers.

Anti-foaming agents such as silicone polymers, e.g., dimethyl silicone polymer, can also be used, generally in amounts from about 5–50, preferably 10–30 parts per million by weight of the finished oil.

When desired, additional improvements with respect to oxidation stability and scuffling inhibition can be imparted to the oil compositions of the invention by incorporating small amounts (0.01%–2%, preferably 0.1% to 1%) of phenolic antioxidants such as alkylphenols, e.g., 2-6-ditert.butyl-4-methylphenol or p,p'-methylene bisphenols such as 4,4'-methylene-bis(2,6-ditert-.butylphenol) or arylamines such as phenylalphanaphthylamine; dialkyl sulfides, sulfurized olefin esters, and mixtures thereof, e.g. dibenzyl disulfide or didodecyl sulfide. Anti-scuffing agents include esters of metal salts or organic phosphites, phosphates, phosphonates and their thio derivatives, such as $C_{3-11}$ trialkyl phosphites or phosphonates, e.g., tributyl-, trioctyl, trilauryl- or tricresylphosphites or phosphates.

Preferred crankcase formulations will include pour point depressants such as acrylate, methacrylate and styrene succinate ester polymers in amounts from 0.1 to 5% and preferably from 0.2 to 0.5% by weight.

The improved crankcase lubricants according to the invention are most suitably employed in four stroke otto cycle engines. Very limited testing to date of these improved formulations in diesel engines has been insufficient to show advantage which can be considered to be statistically significant.

The invention will be further understood by reference to the following examples which demonstrate the ability of the present oil compositions to significantly improve fuel economy.

EXAMPLE I

In this example friction tests were conducted on formulations prepared in an SAE 10w-40 SE quality automotive engine oil. The base motor oil used in the test was formulated using a neutral mineral oil and contained a commercial ashless dispersant (i.e. polyisobutenyl succinate of penta erythritol a highly overbased calcium sulfonate, (400 TBN) a zinc dialkyl dithiophosphate, a commercial hydrogenated styrene-diolefin block copolymer viscosity index improver, a polystyrene succinate ester pour point depressant and a silicone-based anti-foam agent. The kinetic coefficient of friction was measured using a 4-ball test apparatus with four AL Si-52100 Steel Balls (½ Diameter ±0.0001 tolerance) at 3300 RPM at 121° C. (250° F.) using a step load technique in which the load is increased at 3 kilogram (kg) increments on the range 3–24 kg at 2 minute intervals and the coefficient of friction measured at each load. Measurements for the base oil and for the base oil containing various concentrations of additives according to the invention are given in the following table.

TABLE I

| | COEFFICIENT OF FRICTION AS A FUNCTION OF LOAD | | | | | | | |
|---|---|---|---|---|---|---|---|---|
| Oil | 3 Kg | 6 Kg | 9 Kg | 12 Kg | 15 Kg | 18 Kg | 21 Kg | 24 Kg |
| Base Oil | 0.038 | 0.102 | 0.170 | 0.234 | 0.293 | 0.354 | 0.414 | 0.469 |
| 0.1% w oleamide | 0.043 | 0.104 | 0.164 | 0.225 | 0.277 | 0.328 | 0.374 | 0.415 |
| 0.2% w oleamide[1] | 0.030 | 0.089 | 0.154 | 0.203 | 0.249 | 0.295 | 0.342 | 0.383 |
| 0.5% w oleamide | 0.033 | 0.087 | 0.145 | 0.203 | 0.245 | 0.293 | 0.359 | 0.385 |
| 0.5% w stearamide | 0.044 | 0.102 | 0.168 | 0.225 | 0.270 | 0.314 | 0.357 | 0.393 |
| 0.1% w stearamide[2] | 0.038 | 0.097 | 0.155 | 0.212 | 0.257 | 0.303 | 0.348 | 0.390 |
| 0.2% w stearamide[2] | 0.038 | 0.096 | 0.155 | 0.212 | 0.252 | 0.298 | 0.340 | 0.380 |
| 0.75% w linolenamide[3] | 0.030 | 0.086 | 0.141 | 0.200 | 0.250 | 0.300 | 0.350 | 0.401 |

[1]Technical grade, average composition 9-octadecenamide 79.5%, tetra decanamide 4.5%, hexadecanamide 9.5%, 9,12 octadecadienamide 4.0%, other amides 2.5%.
[2]Technical grade, average composition octadecanamide 86.5, hexadecanamide 7%, heptadecanamide 2.5%, 9-octadecenamide 4%.
[3]Laboratory prepared, greater than 90% purity.

EXAMPLE II

As it is known that some additives which reduce friction in a bench test do not improve fuel economy in actual use, further tests were carried out in 10 U.S. production automobiles having automatic transmissions and engines smaller than 400 CID and having accummulated at least about 15,000 miles to reduce the effect of normally increased fuel economy typically obtained during the "break in" period of an engine. The cars used in these tests were owned by co-workers of applicants.

The sequence of testing of cars was to flush the engine crankcase twice with the reference oil or Example I and charge the crankcase with that oil. The fuel economy of the car was then measured using a procedural refinement of the EPA City/Highway test procedure ('75 FTP/HFET). The procedure used is essentially the same as that recently developed by the ASTM Fuel Efficient Engine Oil Task Force. In this procedure the car is driven over the EPA City/Highway driving cycles on a Clayton dual roller dynamometer while fuel consumption is measured gravimetrically. The dynamometer load and inertia were set as specified by the Code of Federal Regulations for that individual car. The fuel economy tests were conducted from a cold start after a nominal 20-hour soak period. Environmental temperatures during the soak period and during the test were controlled between 68° to 74° F.

line indicating that the change in fuel economy with the candidate fuel saving motor oil was indeed due to the oil.

Nine of the ten cars completed the full program. The tenth car, the 1972 Maverick, completed approximately three-fourths of the total testing. The fuel saving motor oil provided a statistically significant improvement in fuel economy in eight of the ten cars. The remaining two cars did show a slight positive effect but at low certainty level. The fuel saving oil appeared to require a break-in or conditioning period in two of the cars tested. In these cars the first test, zero oil miles, on the candidate oil gave a fuel economy within the population of the results on the reference oil. The additional tests at increased oil miles were, at a high level of certainty, different from the reference oil. Therefore, for these two cars the zero oil miles result on the candidate oil was not used in the calculation of average fuel economy.

TABLE II

CARS TESTED AND RESULTS
Fuel Economy Data, MPG

| Car Tested | Reference Oil | Ref. oil + 0.2% w tech. Oleamide | Improvement w/ Oleamide | Level of Certainty |
|---|---|---|---|---|
| 1977 Buick LaSabre 350 CID V-8 | Ave: 18.2639[1] | Ave: 18.7680[2] | 2.76% | >99% |
| 1977 Ford F-150 351 CID V-8 | Ave: 13.8370 | Ave: 14.1962 | 2.60% | >99% |
| 1975 Ford Elite 351 CID V-8 | Ave: 14.0010[1] | Ave: 14.2371 | 1.69% | >99% |
| 1974 Oldsmobile Delta 88 350 CID V-8 | Ave: 14.3939[1] | Ave: 14.6808 | 1.99% | >99% |
| 1976 Oldsmobile Cutlass 350 CID V-8 | Ave: 16.3837[1] | Ave: 17.0964 | 4.35% | >99% |
| 1976 Ford Granada 302 CID V-8 | Ave: 17.2073[1] | Ave: 17.6632 | 2.65% | >99% |
| 1976 Buick Century 350 CID V-8 | Ave: 13.5613 | Ave: 14.3396[2] | 5.74% | >99% |
| 1973 Ford Pinto 2.3l I-4 | Ave: 22.2923 | Ave: 22.3833 | 0.41% | >40% |
| 1977 Ford LTD-II 302 CID V-8 | Ave: 15.7519 | Ave: 15.8013 | 0.31% | >30% |
| 1972 Ford Maverick 200 CID I-6 | Ave: 21.2502 | Ave: 21.7676 | 2.43% | >99% |
| Fleet Results | Ave: (harmonic) 16.2282 | Ave: (harmonic) 16.6438 | 2.56% | >99% |

Ave = Average test result, MPG
[1]Includes reference oil result obtained after tests of Fuel Saving Oil
[2]Result after oil conditioning; zero oil miles on Fuel Saving Oil fit population of results on reference oil rather than remaining population of results on Fuel Saving Oil After the first fuel economy test at zero oil miles on the reference oil, the car was returned to its owner for mileage accumulation through the normal use of the car. At nominal 1,000 mile intervals the fuel economy was again measured using the EPA City/Highway test procedure, after 4,000 to 7,000 miles of operation with periodic fuel economy testing, the crankcase was flushed twice with the fuel saving motor oil (according to the invention, i.e., the same reference oil to which had been added 0.2%w of Technical grade oleamide) and then filled with that oil. The fuel economy of the car was measured again at mileage intervals similar to those of the reference oil.

In five of the cars, after the completion of all testing of the candidate fuel saving motor oil, the reference oil was again tested to further confirm that the improvement in fuel economy was due to the new fuel saving candidate oil and not a time or mileage effect within the car. In all cases where the reference oil was retested, the fuel economy returned to the level of the original base- The improvement in fuel economy with the motor oil composition according to the invention ranged from 0.31 to 5.74% on individual cars with a statistically significant average improvement of 2.56%.

EXAMPLE III

The effectiveness of linolenamide was tested in actual use in a 1977 Ford Pinto and 1977 Chevrolet under the fuel economy test procedure of example II. The reference oil was a fully compounded crankcase oil marketed under the tradename SHELL X-100® MULTIGRADE (10W40) and the fuel economy oil according to the invention was the reference oil to which had been added 0.75%w linolenamide. The effect on fuel economy of each oil was measured by repeat tests with the new oil and after 1,500 miles of operation. As shown in Table III the use of the fuel economy oil resulted in fuel economy improvements ranging from 1.04% to 4.54% at the 90% to 99% confidence level.

TABLE III

FUEL ECONOMY - EPA CITY/COMPOSITE, MPG

| | Reference Oil | | Fuel economy and (Reference Oil + 0.75% w linolenamide) | | % Improvement Test Oil Over Reference Oil | |
|---|---|---|---|---|---|---|
| Car Tested | New Oil | 1500 Oil Mi | New Oil | 1500 Oil Mi | New Oil | 1500 Oil Mi |
| 1977 Ford Pinto, 2.31 I-4 | 22.7909 | 23.1872 | 23.3082 | 23.4380 | +2.27 | +1.08 |
| 1977 Chevrolet Nova, 305 CID V-8 | 16.7217 | 17.2294 | 17.4809 | 17.4094 | +4.54 | +1.04 |

What we claim is:

1. In a motor oil composition formulated for use as a crankcase lubricant in internal combustion engines, said oil containing an ashless dispersant, and an oil-soluble detergent sulfonate and/or phenate the improvement comprising including an effective amount of at least one $C_8$–$C_{24}$ aliphatic monocarboxylic acid amide sufficient to reduce fuel consumption of an internal combustion engine when employing said motor oil compositions as the crankcase lubricating oil of said engine, said aliphatic monocarboxylic acid amide having the general formula:

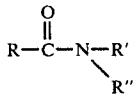

wherein R is an alkyl or alkenyl hydrocarbyl radical of 8 to 24 carbon atoms, and R′ and R″, which may be the same or different, are hydrogen or lower alkyl radical having up to 7 carbon atoms.

2. A composition as in claim 1 wherein the general formula R is an alkyl group of 12 to 20 carbon atoms and R′ and R″ are selected from hydrogen and alkyl radicals of 1 to 4 carbon atoms.

3. A composition as in claim 1 wherein the general formula R is an alkenyl group containing up to three double bonds.

4. A composition as in claim 3 wherein R′ and R″ are each hydrogen.

5. A composition as in claim 1 wherein said amide is present in amounts between about 0.01 and 3.0 percent by weight.

6. A composition as in claim 1 wherein a zinc dithiophosphate is present in amounts in the range from 0.1 to 2.5% by weight.

7. A composition as in claim 1 wherein a viscosity improver is present in amounts between 0.1 and 3.0 by weight.

8. A composition as in claim 1 wherein a pour point depressant and an antifoam agent are also present.

9. A composition as in claim 1 wherein said ashless dispersant is a polyisobutenyl succinic ester/amide or a polyisobutenylsuccinimide.

10. A method for reducing the fuel consumption of an internal combustion engine which comprises incorporating into the crankcase lubricant of said engine an effective amount of at least one $C_8$–$C_{24}$ aliphatic monocarboxylic acid amide sufficient to reduce the fuel consumption of said engine, and operating said engine for a time sufficient to disperse said aliphatic monocarboxylic acid amide throughout the oil-contacted surfaces of said engine, said aliphatic monocarboxylic acid amide having the general formula:

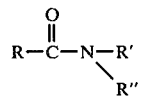

wherein R is an alkyl or alkenyl hydrocarbyl radical of 8 to 24 carbon atoms, and R′ and R″, which may be the same or different, are hydrogen or a lower alkyl radical having up to 7 carbon atoms.

* * * * *